United States Patent [19]

Brundiek

[11] 4,218,023

[45] Aug. 19, 1980

[54] GRINDING PAN BEARING ARRANGEMENT AND DRIVE OF A ROLLER MILL

[75] Inventor: Horst Brundiek, Neuss, Fed. Rep. of Germany

[73] Assignee: Loesche GmbH, Dusseldorf, Fed. Rep. of Germany

[21] Appl. No.: 870,092

[22] Filed: Jan. 17, 1978

[30] Foreign Application Priority Data

Jan. 28, 1977 [DE] Fed. Rep. of Germany ..... 2703535

[51] Int. Cl.[2] ..... B02C 15/00

[52] U.S. Cl. ..... 241/121; 308/9

[58] Field of Search ..... 241/110, 117, 118, 119, 241/120, 121, 122; 308/9, 5 R

[56] References Cited

U.S. PATENT DOCUMENTS

| | | | |
|---|---|---|---|
| 2,192,310 | 3/1940 | Hartshorn | 241/120 X |
| 2,689,689 | 9/1954 | Engler | 241/121 |
| 2,875,959 | 3/1959 | Calkins | 241/119 X |
| 3,366,338 | 1/1968 | Bartor | 241/117 |
| 3,656,695 | 4/1972 | Bacharach | 241/117 X |
| 3,658,264 | 4/1972 | Schauer | 241/121 |
| 3,675,977 | 7/1972 | Arsenius et al. | 308/9 |
| 3,799,628 | 3/1974 | Van Gaasbeek et al. | 308/9 X |
| 4,155,511 | 5/1979 | Kartman et al. | 241/117 |

*Primary Examiner*—Gary L. Smith
*Assistant Examiner*—Robert P. Olszewski
*Attorney, Agent, or Firm*—Holman & Stern

[57] ABSTRACT

The specification describes a roller mill comprising a rotary grinding pan and grinding rollers adapted to roll on this grinding pan and which are journalled stationarily though with a provision for vertical pivoting. In accordance with the invention the grinding pan is supported by at least three hydrostatic axial individual bearings, which are arranged substantially symmetrically with respect to the grinding pan and can take up all vertical loads.

7 Claims, 9 Drawing Figures

3
2
1
4
5
5
7
12
17
6
14
18
15
16
15a

GRINDING PAN BEARING ARRANGEMENT AND DRIVE OF A ROLLER MILL

BACKGROUND OF INVENTION (1) Field to which invention relates

The invention relates to a roller mill comprising a rotary grinding pan and grinding rollers adapted to roll on this grinding pan and which are journalled stationarily though with a provision for vertical pivoting.

(2) The prior art

In the last few decades the power, dimensions and weight of roller mills have substantially grown. This trend particularly affects the transmissions, which have had to be designed for larger and larger loads, since they comprised the axial thrust bearing, which serves for taking up the grinding pressure. In the case of the prior art mill design the grinding forces, produced by the rollers, were taken up by an axial thrust bearing, which was fitted in the housing of a mill transmission. The axial loads have increased in the course of mill development to such a degree that there are constantly more exacting requirements as regards the stiffness of the transmission housing and the degree of precision with which it is machined. Since the transmissions therefore in fact consist of the torque converter as one element and the axial thrust bearing as the other element serving for taking up the grinding pressure, the overloading of only one element has frequently meant the breakdown of the whole system. The precision machining of the transmission housings, which presently reach a weight of up to approximately 100 tons gives rise to exacting requirements in manufacture and considered in isolation in fact represents an excessive cost factor. Even small inaccuracies in manufacture frequently lead to premature breakdown owing to the high loads involved. Transmission have already been in use with operating loads of 575 Mp and dynamic additional loads of 2800 Mp.

SHORT SUMMARY OF THE INVENTION

One aim of the invention is accordingly that of divorcing the drive in the restricted sense, that is to say the torque converter or the torque producer on the one hand,from the axial thrust bearing system on the other hand. In this respect it was necessary to develop a construction of the axial thrust bearing system, which while fulfulling technical and economic requirements, made possible a further increase in the size of mills and therefore of their outputs. In order to attain this purpose it is necessary to sacrifice the previously demanded extremely high manufacturing accuracy in order to reduce costs without however simultaneously sacrificing operational reliability.

The use of hydrostatically lubricated bearings for taking up high loads has already been proposed. Hydrostatic bearings developed have included individual elements, which are used for other purposes. Such bearing elements cannot readily be used for roller mills. The pith of the invention therefore resides in so designing a roller mill that hydrostatic bearings can be employed, which are not organically and spatially tied to a transmission housing. Furthermore there is to be the possibility of making a suitable selection of a certain number of bearing elements to allow adaptation to the loads, to be designed for in a particular application which are produced by the grinding rollers.

In accordance with the invention the grinding pan is supported against at least three hydrostatic axial individual bearings, which with respect to the grinding pan are arranged substantially symmetrically and can take up all the vertical loads. These elements are to be combined with radial elements, which are also hydrostatically lubricated and serve for guiding the grinding pan (in the case of conventional drives the grinding pan was guided by radial bearing of the transmission output drive shaft).

In the case of a preferred embodiment of the invention a support ring (race ring) is arranged under the grinding pan and it distributes all vertical and horizontal loads, acting on the grinding pan, between the hydrostatic individual bearings. The latter transmit the loads directly to th foundation of the mill or, via the mill housing, onto the mill foundation so that preferably the drive parts and the transmission remain free of horizontal and vertical loads. In the case of the use of at least two grinding rollers there is the proposal of providing at least one pair of hydrostatic individual bearings for each grinding roller in such a manner that all individual bearings are arranged symmetrically with respect to the grinding pan and, respectively its axis. In accordance with the invention it is also possible to arrange a larger number of hydrostatic individual bearing symmetrically along a circular line, and in the case of the use of different bearings with different carrying capacities it is possible furthermore to vary the distance between the individual bearings. Furthermore in accordance with the invention it is possible, in lieu of a support ring with horizontal and a vertical cylindrical race ring for support against axial bearings and separate radial bearings, to employ a support ring, which at its bearing race surface is machined so as to conical or barrel-shaped. This ring would then be supported on obliquely set bearing elements, which owing to their oblique setting can take up both axial and also radial load components.

When hydrostatic bearings are used the invention has the aim of so developing the bearing elements that on using more than three individual elements, which ensure a statically determined supporting action, nevertheless all bearing elements are loaded evenly or approximately evenly; that is to say the bearing elements must all posses a means for precision adjustment, with which they can be set as regards engagement on the race surface of the support ring. In the case of previously proposed construction a hydrostatic bearing can be vertically adjusted and is supported on a spherical cap member, while the latter is journalled with its holding means on a wedge plate, which can be displaced in the direction of its slope laterally using conventional means. In the case of another well known construction the setting of the hydrostatic bearings can be regulated hydraulically using a piston arrangement. In this case a respective main element and an auxiliary element are hydraulically linked with each other.

the possibility of adjustment is more especially necessary also because a less exacting precision machining of the bearing support system is to be dispensed with in order to reduce costs. The purpose is that of ensuring support of the bearing elements as far as possible with unmachined or cheaply produced parts. In the case of one embodiment the welded mill housing is used for this purpose, while in the case of another embodiment use is made for example of a concrete support means with a steel coping, on which the elements are attached.

The bearing arrangement in accordance with the invention finally provides the possibility of using drive members, which can be kept free of external forces. In the case of one embodiment a high speed electric motor with a following transmission is arranged between the hydrostatic individual bearings for the purpose of producing a vertical drive. In the case of another embodiment for drive as a direct drive system for the grinding pan use is made of a low speed electric motor without any torque converter, arranged in the mill housing between the hydrostatic bearings and in the case of a still further embodiment, modified to depart from the last mentioned embodiment, a low speed electric motor is provided as a direct drive. It is arranged, without any torque converter, in the mill foundation below the mill. For the two direct drives the axis of rotation of the grinding pan and the axis of rotation of the motor coincide so that there is symmetry around the axis of rotation between the support means and the drive.

LIST OF SEVERAL VIEWS OF THE DRAWINGS

In the accompanying drawings several embodiments of the invention are shown.

Figure 1:
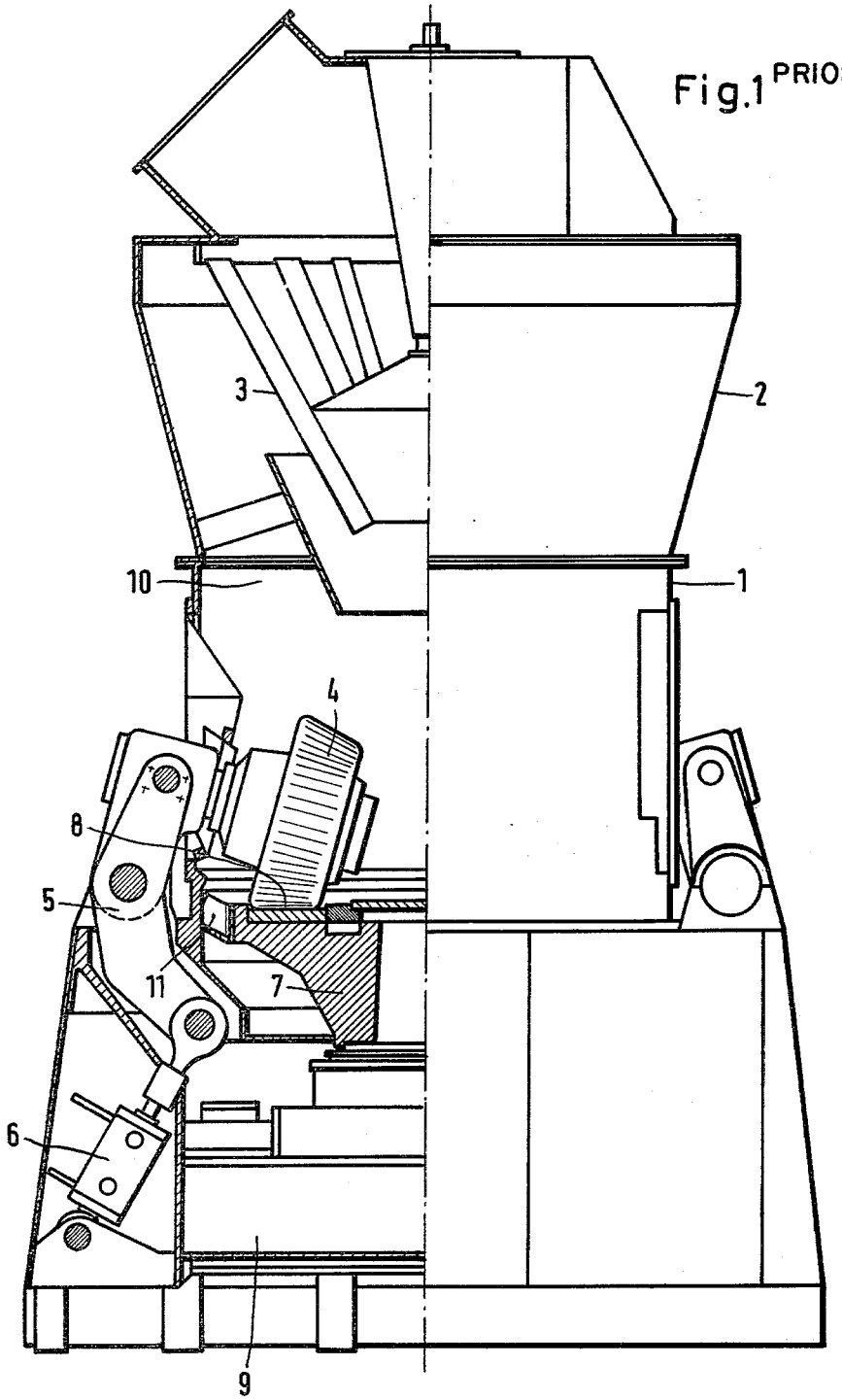
Fig.1 PRIOR ART
FIG. 1 shows a conventionally constructed prior art roller mill with a rotating grinding pan,on which grinding rollers roll and which are stationarily journalled though with a provison for vertical pivoting. There is the provision of a bevel spur gear-wheel drive and a thrust bearing arrangement incorporating this vertical transmission.

The roller mill represented in FIG. 1 comprises a housing 1 for receiving the grinding members and the classifier housing 2 for accepting the classifier rotor 3. The grinding members comprise the pivotally journalled grinding rolls 4, which by virtue of a pivoting lever 5 and a hydraulic cylinder 6 can be vertically pivoted. The grinding rollers run on a rotary grinding pan 7., which is armored with plates 8 of wear resistant material. The pressure or thrust cylinder 6 is provided with means for supplying hydraulic medium. FIG. 1 shows the ducts which serve for supplying and removing the hydraulic medium. The drive of the grinding pan is via a transmission 9. The roller mill operates with a suspending medium, which can be in the form of air or other compressible fluid. This medium is admitted to the grinding space 10 by way of a vane ring 11.

DESCRIPTION OF PREFERRED EMBODIMENTS OF INVENTION

Figure 2:
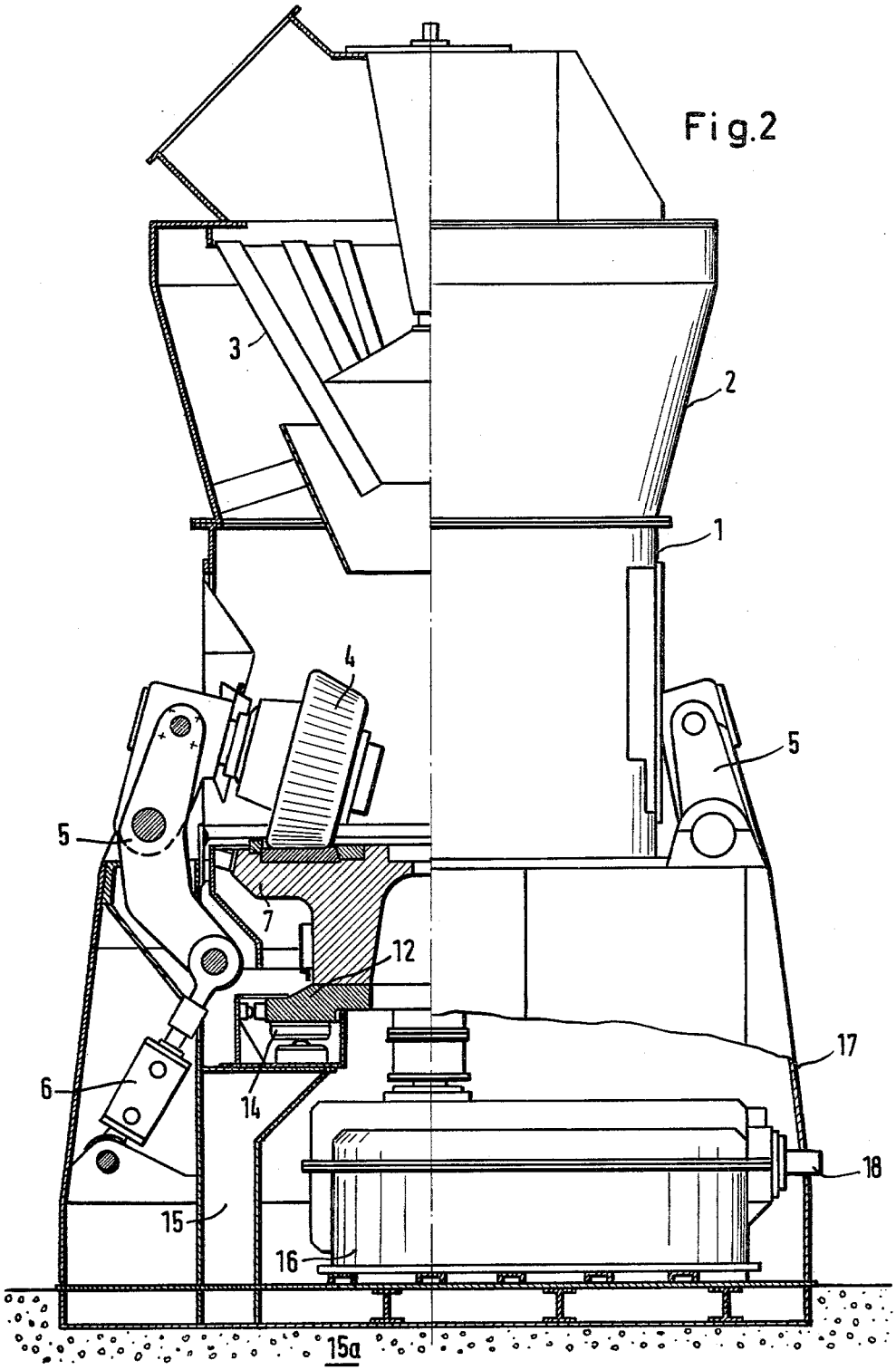
FIG. 2 shows a diagrammatic view of a roller mill in accordance with the invention, which is shown on the left in section and on the right in elevation. The drive is transmitted via a bevel spur gear-wheel vertical transmission, free of external forces, without any thrust bearing arrangement.

The roller mill in accordance with FIG. 2 is distinguished from the roller mill as shown in FIG. 1, more especially by the arrangement of a support ring (race ring) 12 beneath the grinding pan 7. This ring 12 transmits the vertical grinding forces and the horizontal guide forces to hydrostatically lubricated bearings 14. From this position the loads are passed on via the mill housing 15 (or directly via a support construction, not shown here, divorced from the mill housing) to the foundation 15*a*. The lower part of the roller mill with the transmission 16 is accommodated in a housing casing 17. The drive via the transmission 16 is from the outside via a shaft 18. The lower housing part 17 is so constructed that it forms a support for the grinding rollers 4 with the pivoting levers 5 as will be more especially apparent from the part of FIG. 2 on the right.

Figure 3:
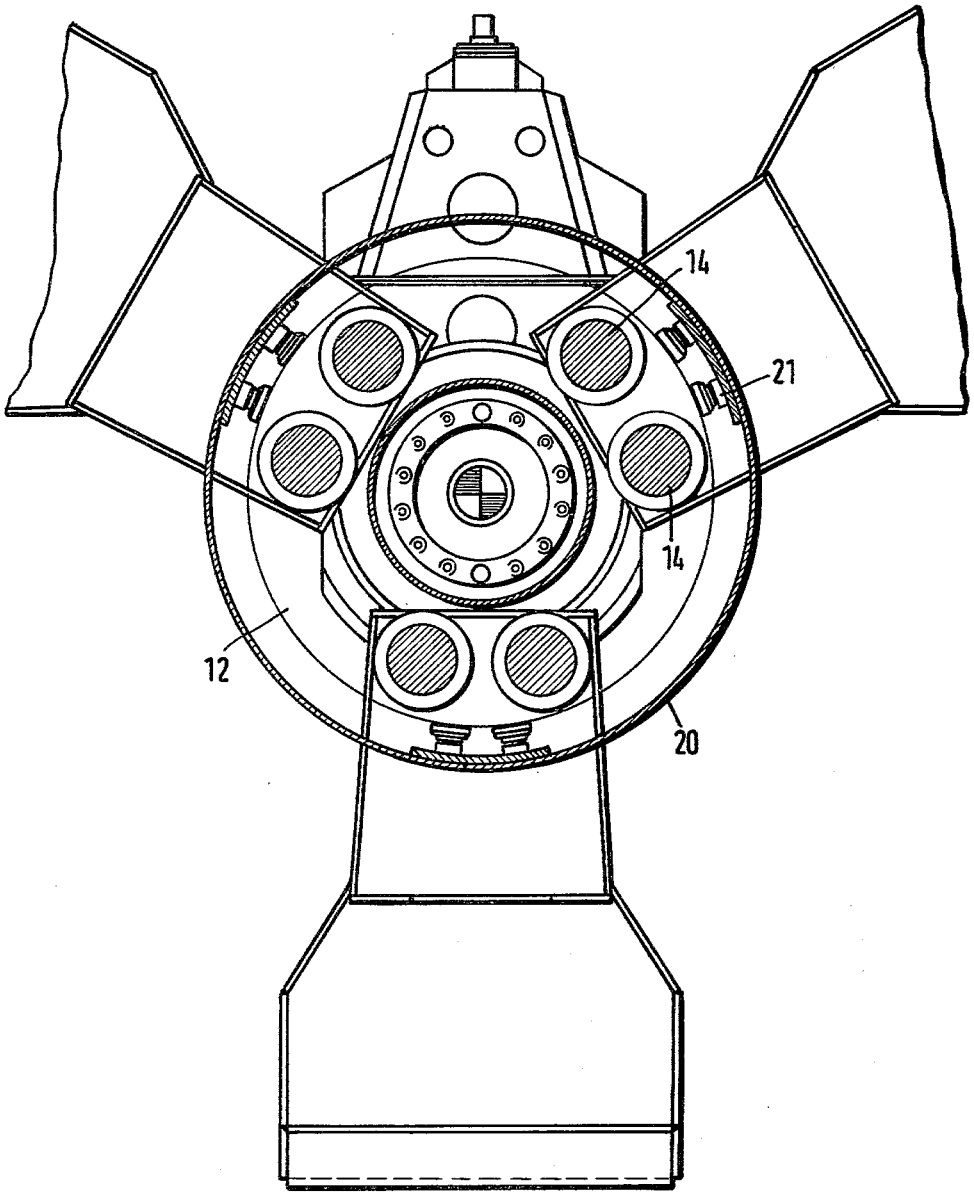
FIG. 3 shows diagrammatically a plan view showing the bearing arrangement of a grinding pan with three grinding rollers having hydrostatic axial and radial bearings for them.

FIG. 3 shows diagrammatically the disposal of hydrostatic bearings 14, which are respectively arranged in pairs, that is to say one pair for each grinding roller. This representation furthermore shows in a very clear manner the lateral support of the support ring 12 on the housing part 20, whose arrangement will be gathered from FIG. 2. These hydrostatic bearings for the lateral support are denoted by reference numeral 21 in FIG. 3. As regards understanding the drawing it is to be noted that the outline of the support ring is designated by a thin line, because the support ring is located above the hydrostatic bearing 14 and is in fact not visible.

Figure 4:
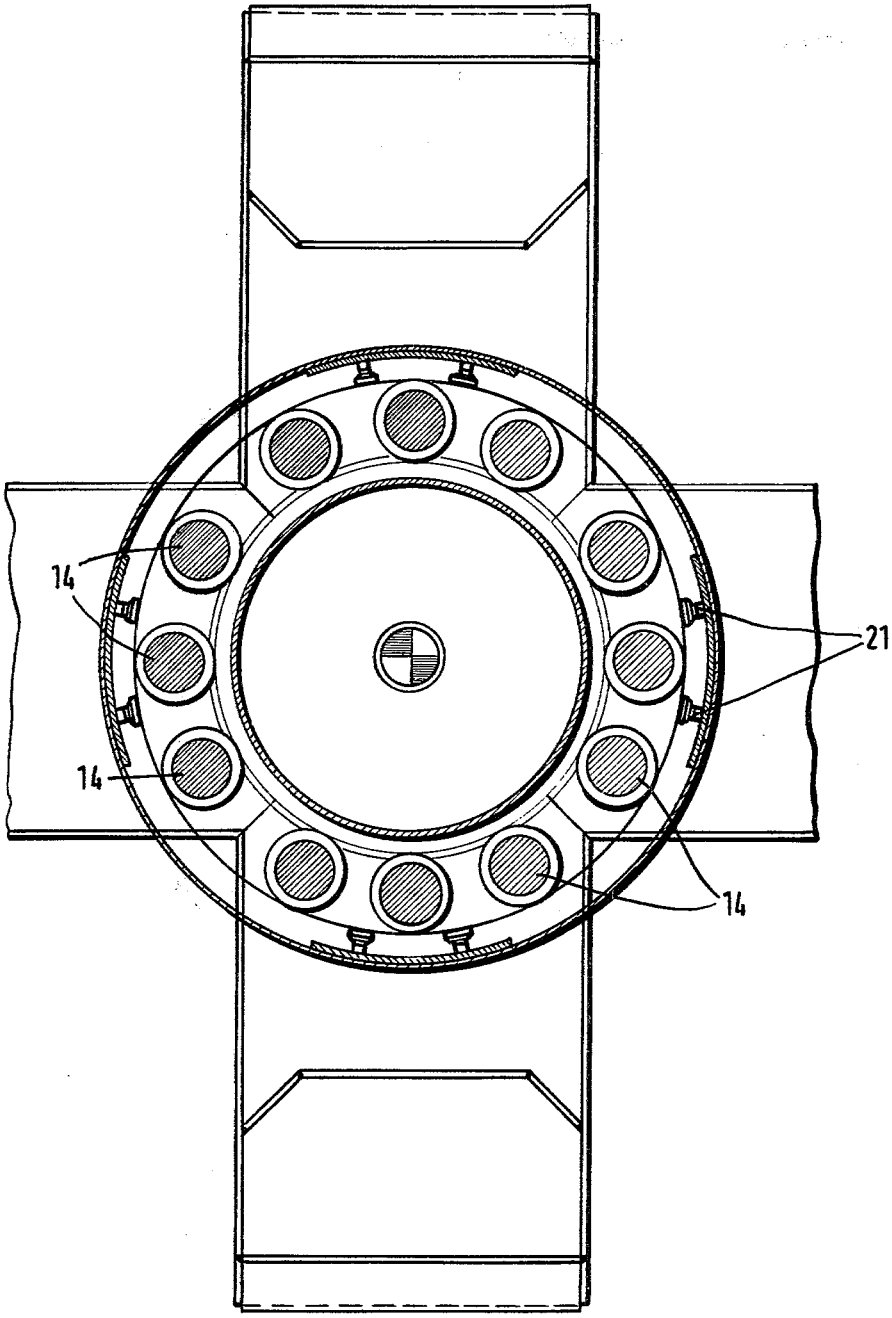
FIG. 4 shows in the view resembling that in FIG. 3 several hydrostatic bearings, arranged in an annular configuration, for four grinding rollers.

FIG. 4 shows an embodiment, in the case of which the hydrostatic bearings 14 are arranged along a circular line, there being in this case three respective bearings for one grinding roller. The construction shown is a mill with four rollers. In other respects the view corresponds to that of FIG. 3.

Figure 5:
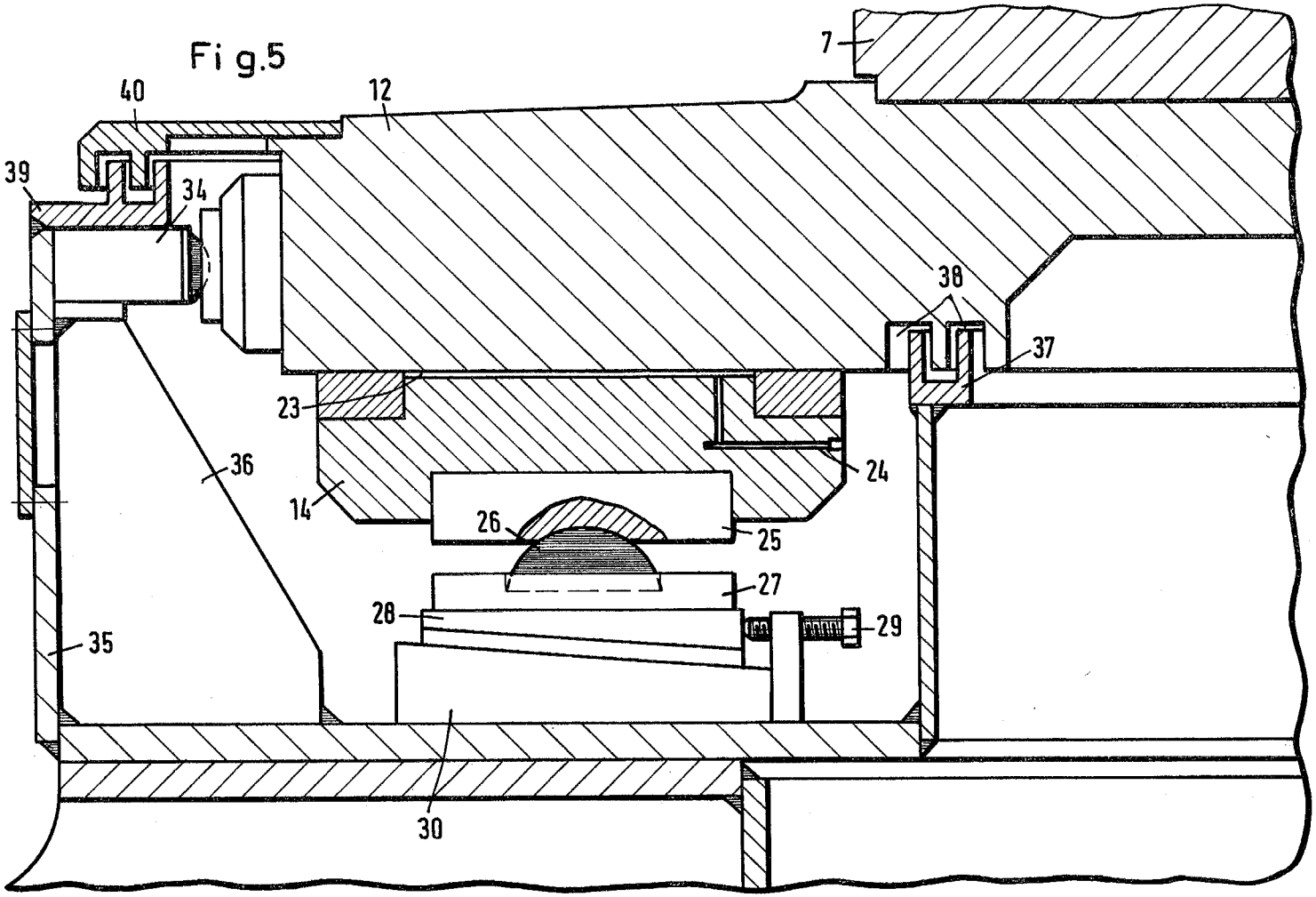
FIG. 5 shows diagrammatically in elevation a hydrostatic bearing with means for vertical adjustment and furthermore lateral adjustment of a second hydrostatic bearing for radial support of the support ring.

FIG. 5 shows the embodiment of a hydrostatic bearings, which is made vertically adjustable by the use of adjustment means such as inclined or wedge surfaces.

The view shows the support ring 12, which is carried by a hydrostatic bearing 14. The drawing shows the thrust or pressure surface 23, which is supplied with a pressure medium via the supply duct 24. On the lower side the bearing has an inserted thrust plate 25, which has a recess for a hemisphere 26. The hemisphere 26 is arranged in a plate 27, which rests on a shifting wedge 28, which can be shifted for setting from the side by means of a setting screw 29. Underneath the wedge plate 28 there is a further support plate 30, whose inclination is arranged to ascend to the left. It will readily be understood that the arrangement represented makes possible a very precise setting of the hydrostatic bearing 14 vertically.

These support plates 30 of all bearing elements are supported on the housing 35, which owing to the adjustment of the bearing elements with respect to the support ring 12 do not have to be machined at all or at the most only have to be machined roughly. The housing 35 is constructed as an annular trough in order to catch the oil leaking from the bearing at the thrust surface 23. The housing 35 has at its internal diameter a labyrinth ring 37, which fits into corresponding grooves 38 of the support ring 12 for sealing and at the external diameter it has a labyrinth ring 39, which fits into a corresponding labyrinth ring 40. The labyrinth ring 40 rotates with the support ring 12 and the grinding pan 7. Laterally from the support ring 12 there is a further support (radial guide) 34, which can also be adjusted. Several bearings 34 of this type serve to hold the support ring 12 in a certain position, that is to say they are guided radially.

Figure 6:
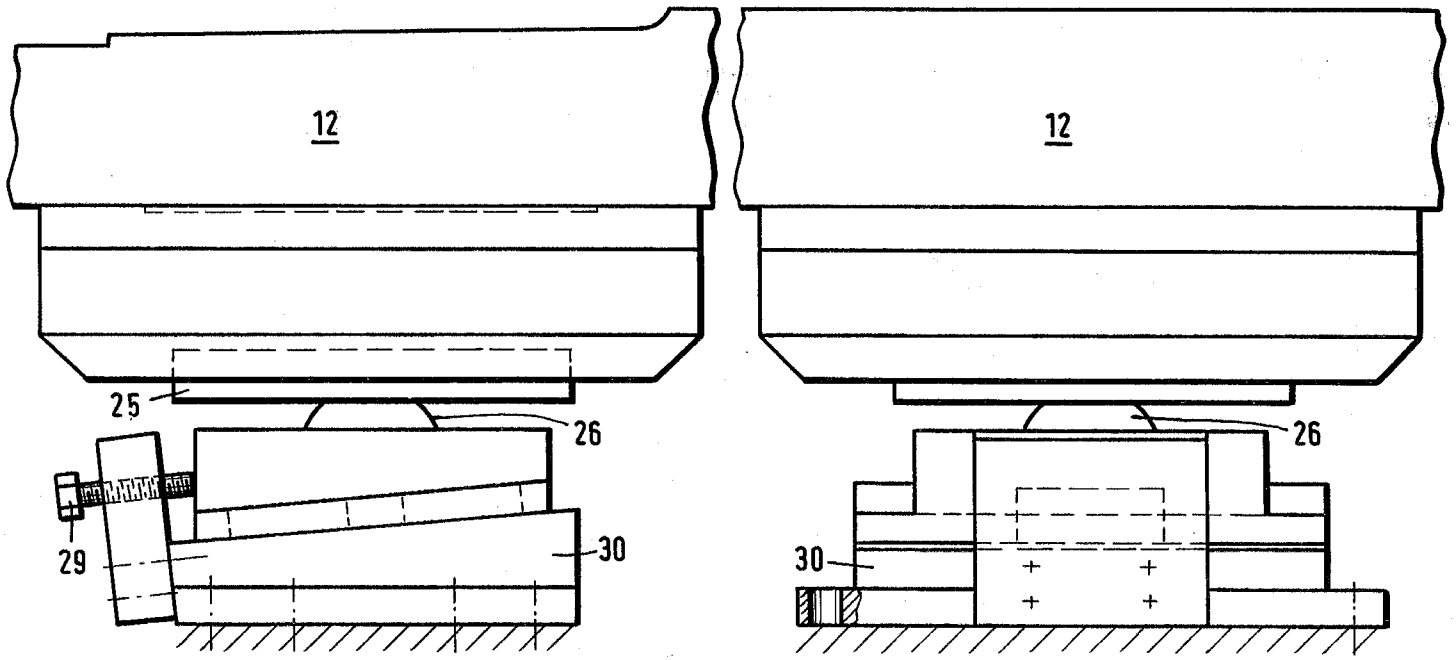
FIG. 6 shows a hydrostatic bearing element in end-on and elevation views with a support ring indicated on it, in accordance with the embodiment shown in FIG. 5.

FIG. 6 shows once again the bearing element of FIG. 5 in two views with the support ring 12 arranged above it.

Figure 7:
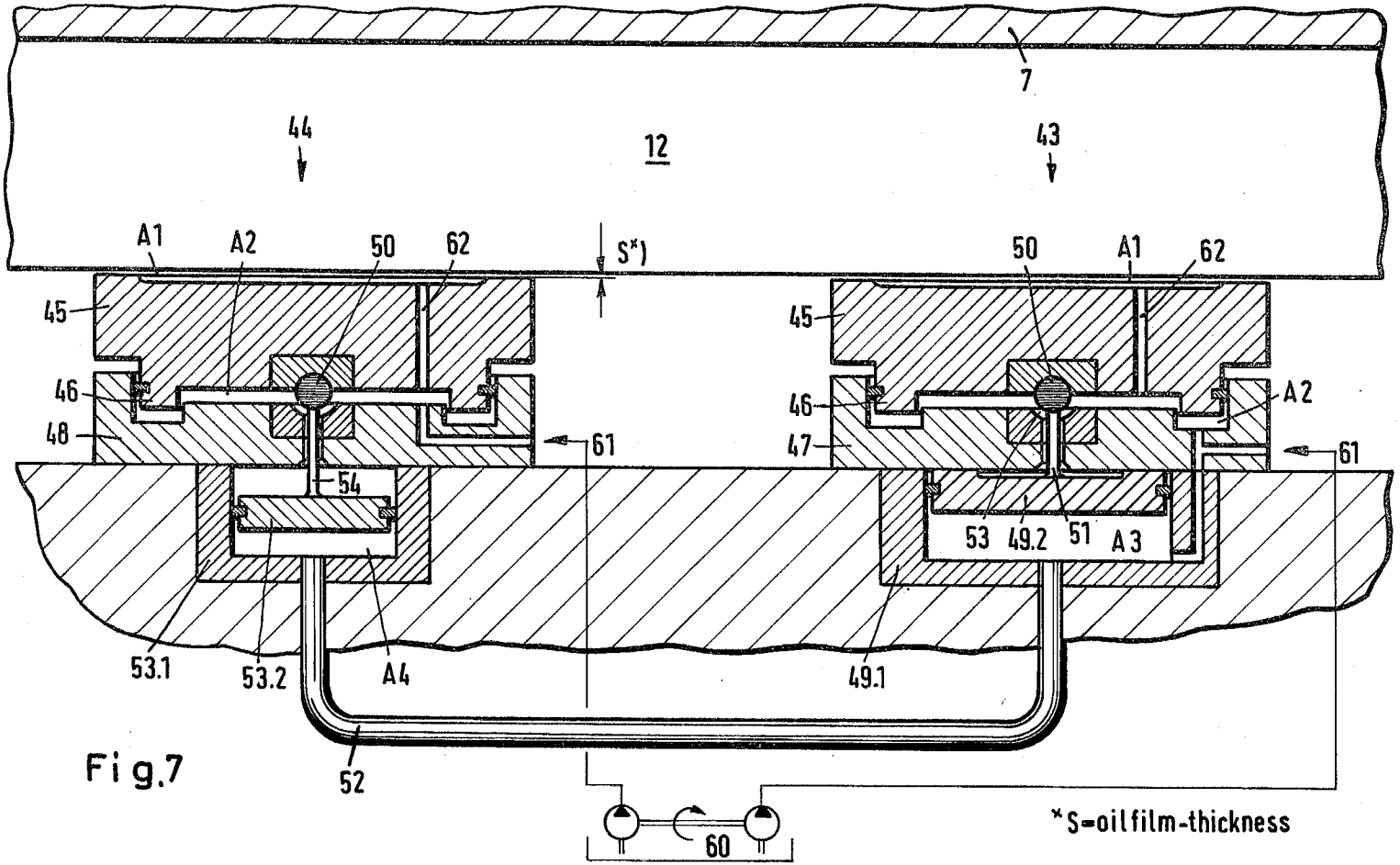
FIG. 7 represents two hydraulically coupled individual elements, whose adjustment is brought about automatically.

FIG. 7 shows two hydrostatic bearing elements, which are hydraulically linked with each other. Reference 43 denotes the so called main element (Master Shoe), while reference 44 indicates the so called ancillary element (Slave Shoe). Each element consists of a support part and the thrust piece 45 with a plain bearing surface. The thrust piece 45 rests on a ball 50, which for its part rests in the support part 47, 48, when the bearing element is not pressurised with oil (reference 61). The thrust piece 45 can also adapt itself to an obliquely set or elastically deformed support ring 12, which slides over it.

For axial support of a support ring in accordance with FIG. 7 three main elements are mounted on an underlying part (that is to say the mill housing or the foundation), which take up the whole load of the support ring 12, when there is no oil pressure at the position 61. The lower side of the thrust piece 45 is constructed as a hemispherical piston 46, which fits into the lower part 47 constructed as a corresponding cylinder. The surface of this piston 46 is denoted by $A_2$. The effective bearing surface is denoted by $A_1$.

Each main element possesses an ancillary cylinder 49.1 and an ancillary piston 49.2 with an effective area or surface $A_3$. The ancillary piston 49.2 has a piston rod 51, which has the ball 50 journalled on it.

Each subsidiary element 44 also possesses an ancillary cylinder 53.1 and an ancillary piston 53.2 with an effective area $A_4$. The ancillary piston 53.2 acts on the piston rod 54 to hold the ball 50 in contact with the lower side of the main piston 46, which forms a component of the thrust piece 45. The ancillary cylinder 53.1 of the subsidiary element 44 is connected via the connecting lines 52 with the ancillary cylinder 49.1 of the main element 43.

As is the case with the main element 43 in the case of the subsidiary element 44 the piston 46 is made hemispherical and is fitted into the lower part 48 as a corresponding cylinder. The piston 46 of the subsidiary element 44 has the same area $A_2$ as the piston 46 of the main element 43. The effective bearing surface or area of the subsidiary element 44 also amounts to $A_1$ as is the case with the main element 43.

The lower parts 47 and 48 are provided with oil connections 61. The areas $A_1$ and $A_2$ are acted upon by the same oil pressure, since they are connected with each other via the ducts 62.

All main and subsidiary elements are supplied with the same constant oil volume flow. Since the elements are to be lubricated with the same oil film thickness, the load on each element must be equal. For simplification a case is to be considered in which, in accordance with FIG. 7, only one main element 43 and one subsidiary element 44 are used.

In the main element 43 the same load-dependent pressure acts on the areas $A_1$ and $A_3$ if the sum of $A_2$ and $A_3$ is greater than $A_1$ and $A_1$ is greater than $A_2$. The main element 43 is represented in FIG. 7 as an unloaded ball or sphere 50, that is to say between the ball 50 and its lower support position in the part 47 there is a clearance. The thrust piece 45 reaches a stable position when the ancillary piston 49.2 makes contact with the upper end of the ancillary cylinder 49.1. In this position the piston rod 51 will have cleared the ball 50 from its hemispherical support means to leave a small gap as referenced 53. In this respect the possibility of adjustment of the thrust piece 45 will be increased, because the steel ball 50 is now only in contact with the upper end 51 of the piston rod.

Let it now be assumed that the two elements 43 and 44 have to bear approximately the same load F. When the pressure $P_1$ obtains at the effective bearing area or surface of the main element 43, this pressure will also be applied to the ancillary piston of the subsidiary element 44 with the area $A_4$ owing to the duct connection. In the bearing area $A_1$ of the subsidiary element 44 the pressure $P_2$ is to act. Then the following equation applies $$P_2 \times A_1 = P_2 \times A_2 + P_1 \times A_4.$$

When the elements 43 and 44 bear approximately the same load, we have $$F = P_2 \times A_1 \text{ approx. equal to } P_1 = A_1.$$

In the case of an equalized load and equal bearing areas the pressures $P_1$ and $P_2$ must also be equalized. We than have the equation $$A_1 \text{ approx. equal to } A_2 + A_4.$$

The thrust pieces 45 of the subsidiary elements 44 automatically come to bear against the support ring 12. The number of subsidiary elements 44 will depend upon the load F and the size of the support ring 12, that is to say upon its periphery.

In FIG. 7 the oil supply system is diagrammatically shown and referenced 60. The pumps of the supply system 60, which ensure the supply of equal quantities of oil to the elements, can also be replaced by other suitable hydraulic elements in conjunction with a single pump. For cases in which no very precise distribution of the oil quantity is demanded, it may be assumed that conventional pressure dependent hydraulic components can be used. The oil connections with the individual elements 43 and 44 are referenced 61.

Figure 8:
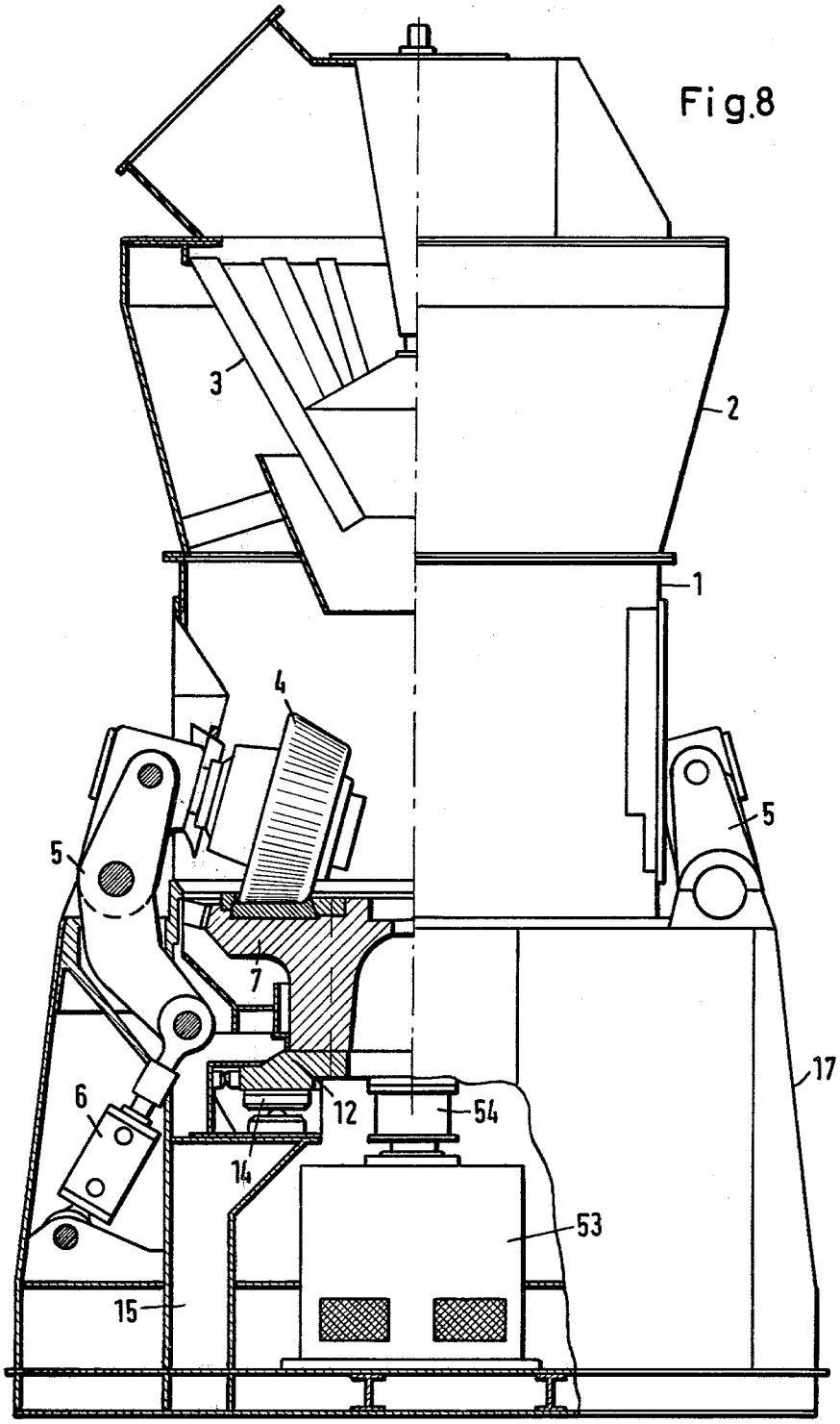
FIG. 8 shows a roller mill, on the left in section and on the right in elevation, which comprises substantially all elements of the view of FIG. 2 though with the drive in the form of a low speed electric motor without any following transmission, and the motor is arranged in the mill housing and drives the grinding pan via a coupling or clutch.

FIG. 8 shows a roller mill, which is represented on the left in section and on the right in elevation. The parts of the roller mill are substantially identical with the showing of FIG. 2 with the exception of drive using a low speed electric motor 53 without any following gearing. Between the motor 53 and the grinding pan 7 there is a clutch 54.

As is known the speed of rotation can be determined by the number of poles. The larger the number of poles the smaller the speed of rotation of the motor. Since the desired speed of rotation is not only to be achieved by the use of a suitable number of poles—a very large number of poles would make an excessively large motor—a separate frequency converter unit is used for producing a further reduction in the motor speed.

Figure 9:
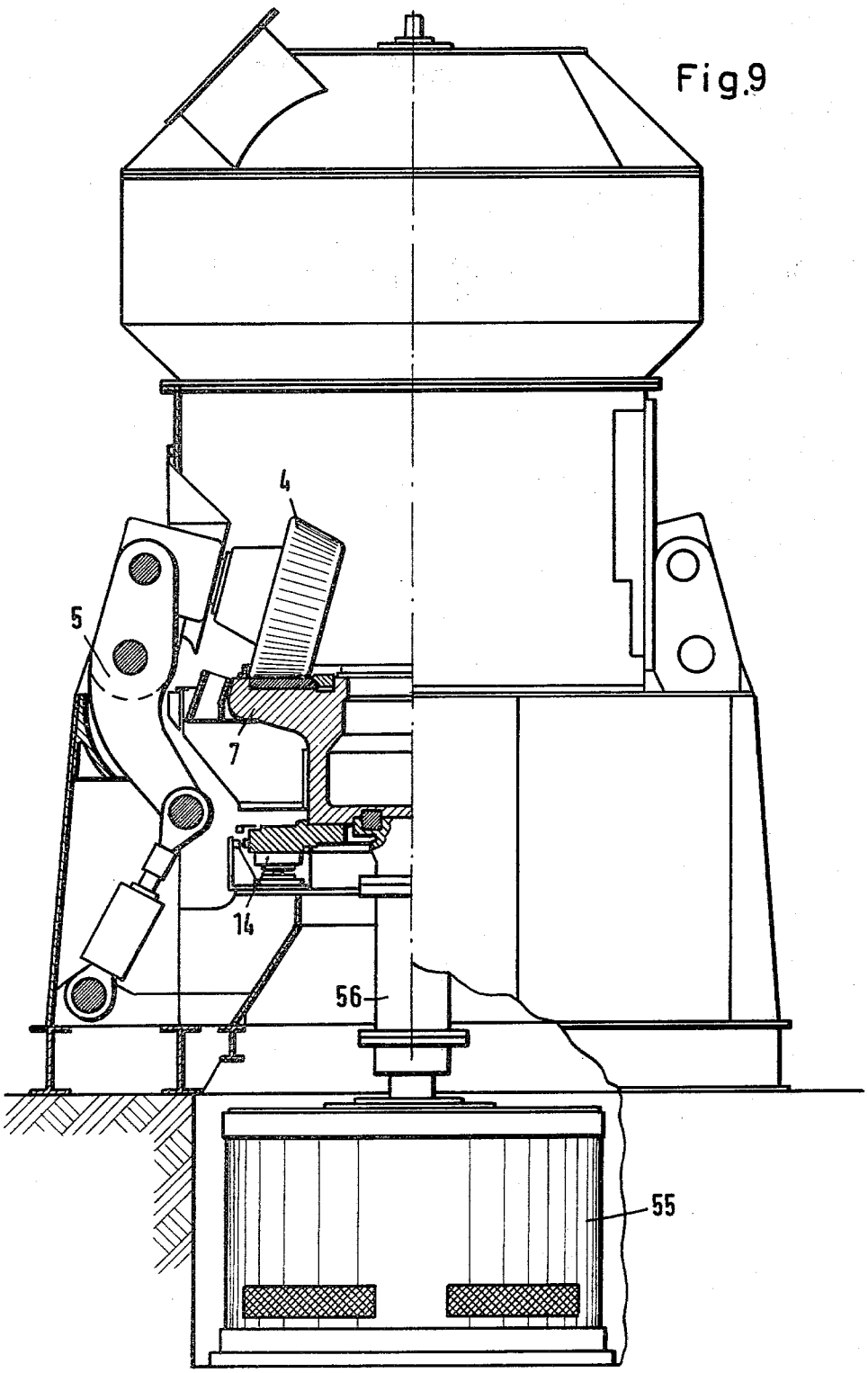
FIG. 9 shows a view of a roller mill, on the left in section and on the right in elevation, with a low speed motor without a torque converter, and the motor is arranged beneath the mill housing in the mill foundation for driving the grinding pan via a clutch with an extension tube.

In the case of the alternative embodiment as shown in FIG. 9 a direct drive for the grinding pan is provided for using the same main elements as in previously described embodiments. As a drive part use is also made of a coupling 56 with extension piece and a low speed electric motor 55 without a torque converter. For reasons of saving space however it is accommodated in the mill foundation.

The embodiments of the invention in which an exclusive property or privilege is claimed are as follows:

1. A roller mill of the type having a housing structure supported on a foundation, a substantially horizontal grinding pan supported for rotation about a substantially vertical mill axis, at least one grinding roller supported by pivotable journals for rolling contact on the grinding pan, means to pivot the rotational axis of the roller to move the roller into and out of engagement with the grinding pan, and driving means below the grinding pan to rotate the grinding pan, comprising, the grinding pan having a horizontal pan section and an integral substantially vertical depending section, a support ring in contact with the lower end of said depending section and having a larger diameter than said depending section to extend radially therebeyond, at least three hydrostatic bearings symmetrically arranged for supporting said support ring at said radially extending location for coaxial rotation with said grinding pan, each bearing being adjustably mounted on a base support element of the housing structure so that they distribute the entire load of the grinding operation through the grinding pan, support ring, and base support elements to the foundation, said base support elements being radially outwardly spaced with respect to said mill axis so that said driving means is readily accessible when in operating position.

2. A roller mill in accordance with claim 1, including a plurality of grinding rolls, wherein said at least three bearings comprise at least one pair of hydrostatic individual bearings for each roll and said pairs being arranged symmetrically with respect to the grinding pan.

3. A roller mill in accordance with claim 2, characterised in that the hydrostatic bearings are provided with an adjustment means comprising a piston arrangement adapted for hydraulically and automatically adjusting said bearings vertically with respect to said support ring.

4. A roller mill in accordance with claim 1 wherein said adjustable mounting for each bearing comprises a wedge member slidably engaging an inclined surface on a bottom plate and a substantially horizontal bottom surface of a top plate, a hemisphere mounted on the top of said top plate with the curved surface up, a thrust plate on the lower surface of said bearing having a hemispherical concave surface engaging said hemisphere, and means to move said wedge member to vertically adjust said bearing.

5. A roller mill in accordance with claim 3, wherein said means for driving comprises a high speed electric motor with a following transmission arranged between the hydrostatic individual bearings for the purpose of producing an axial drive.

6. A roller mill in accordance with claim 3, wherein said means for driving comprises a low speed electric motor arranged symmetrically between the hydrostatic bearings in the mill housing and a coupling directly connecting said motor and said pan.

7. A roller mill in accordance with claim 3, wherein said means for driving comprises a low speed electric motor arranged symmetrically beneath the hydrostatic bearing arrangement in the mill foundation and a coupling with an extension piece directly connecting said motor and said pan.

* * * * *